United States Patent [19]

Scherr et al.

[11] 3,945,409

[45] Mar. 23, 1976

[54] DEVICE FOR FEEDING LENGTHS OF WIRE TO A PROCESSING MACHINE

[75] Inventors: Rudolf Scherr; Walter Jamnig; Hans Gött; Klaus Ritter, all of Graz, Austria

[73] Assignee: EVG Entwicklungs- und Verwertungs-Gesellschaft m.b.H., Graz, Austria

[22] Filed: May 30, 1975

[21] Appl. No.: 582,247

[30] Foreign Application Priority Data

May 30, 1974 Austria ..... 4500/74

[52] U.S. Cl. ..... 140/112; 198/26; 214/1 P; 221/105

[51] Int. Cl.[2] ..... B21F 23/00

[58] Field of Search..... 140/112; 214/1 P; 198/26, 198/104; 221/11, 81, 82, 84, 85, 104, 105

[56] References Cited

UNITED STATES PATENTS

| | | | |
|---|---|---|---|
| 1,923,369 | 8/1933 | Gronemeyer | 140/112 |
| 2,660,287 | 11/1953 | Ames et al. | 198/26 |
| 3,127,829 | 4/1964 | Rossi | 198/104 |
| 3,373,868 | 3/1968 | Missioux et al. | 198/104 |

FOREIGN PATENTS OR APPLICATIONS

| | | | |
|---|---|---|---|
| 1,101,336 | 3/1961 | Germany | 140/112 |

*Primary Examiner*—Lowell A. Larson
*Attorney, Agent, or Firm*—Ernest F. Marmorek

[57] ABSTRACT

Device for feeding lengths of wire to a processing machine, particularly a lattice welding machine, by separating a bundle of wire into smaller portions, aligning the smaller portions, and removing individual wire lengths from the smaller portions for conveyance to the processing machine.

14 Claims, 4 Drawing Figures

DEVICE FOR FEEDING LENGTHS OF WIRE TO A PROCESSING MACHINE

BACKGROUND OF THE INVENTION

The invention relates to a device for feeding lengths of wire to a procesing machine, by means of a separating member acting as a holder separator means for releasing individual wire lengths from a bundle, e.g., a threaded spindle or disc with peripheral grooves cooperating with a stripper member. It is particularly intended to use the device according to the invention for feeding transverse lengths of wire to a lattice welding machine.

From OE-PS No. 189 890 it is known to separate individual wires from bundles of wires and to pass the separate wired on to a processing machine in an orderly manner by picking up the wires at the outer circumference of the loose bundle at a relatively small zone compared to the wire length by means of for example a threaded spindle or disc with peripheral grooves and a separating member cooperating with a stripper and by rotating the spindle or disc at right angles to the longitudinal direction of the wires to separate the wires first of all in the area of the said zone and then to gradually and progressively pull out the wires from the bundle and to completely separate the wires from the bundle.

In the practical application of such devices it is desirable to reduce the operating and attendance time to a minimum, which necessitates in particular that the device be supplied at relatively long time intervals. This necessarily requires that the device be able to handle large quantities of wire at a time. This however results in the danger, particularly with long wires, that the wires in the large bundles deviate considerably from the relative parallel position so that a wire grasped by the separating member cannot be pulled out of the wire bundle without receiving substantial deformation as a result of having been jammed together with the other wires.

The invention deals with the problem of solving this disadvantage and to provide a device of the type referred to at the beginning, on the one hand for directly feeding to it large bundles of wire lengths and on the other hand for enabling it to work the separated wires without interruption and without unacceptable deformations. This object is achieved according to the invention in that the separating member has provided in front of it an endless belt with paddle devices extending away from it to form a rotating endless row of paddles. In an area of upwardly moving paddles in conjunction with slide paths sloping downwards toward the row of paddles there is formed a trough for holding the bundles of wire lengths. The compartment formed between each pair of adjacent paddles of the row of paddles acts as a wire retaining compartment having a storage capacity substantially smaller than the storage capacity of the trough. Directly in front of the separating member there is provided an intermediate storage chamber which has the same storage capacity as that of a compartment of the row of paddles and which receives wires from the compartments.

In the device according to the invention the paddle chain therefore picks up from the trough pre-measured smaller quantities of wires, filling each time a compartment on the paddle chain. These smaller quantities of wire lengths are fed to an intermediate store, in front of the separating member, whose capacity corresponds only to that of a compartment of the paddle chain. From the relatively small wire bundle in the intermediate storage chamber it is then possible by means of the separating member to pick out separate wire lengths safely and without danger of deformation.

In the intermediate storage chamber there is preferably provided a sensor for sensing the presence of a predetermined minimum quantity of wire lengths and which in the absence of this minimum quantity through a control device actuates means for advancing the paddle chain forward one step.

Advantageously along a part of the upwardly moving path of the row of paddles there are provided fixed but preferably adjustable limiter plates which limit the depth of the compartments of the row of paddles. This ensures that after "filling to the brim" of the compartments, by sliding the wires off the limiter plates above the wire bundle, by adjusting the plate a selected part of each compartment remains empty, thereby permitting safe further conveyance of the wire lengths. This aim may be further advanced in that in the area of the upper end of the limiter plates above the path of travel of the paddles there is provided a stripper member. It is then impossible to get a jam between the wires in the various compartments and the wires are further transported in essentially parallel alignment with each other.

According to a further feature of the invention on one side of the row of paddles there is provided a rigid abutment surface for one of the wire ends and on the opposite side there is provided a movable abutment surface for the other wire ends, e.g., in the form of a pivotable flap. By operating the movable abutment surface or the movable flap, which preferably takes place in synchronism with the movement of the row of paddles, it is possible to bring the ends of the wires into a relatively compact position.

According to a still further feature of the invention in the area of the revolving path of the row of paddles opposite the trough there are provided guide panels which form downwardly sloping slide paths extending from the revolving path of the compartments of the row of paddles to the intermediate storage chamber. This has the effect that the wires are fed in an essentially orderly manner and in parallel alignment from the compartments into the intermediate storage chamber.

In a preferred embodiment of the invention the row of paddles has the form of a paddle chain with interlinked L-shaped chain links; such a paddle chain enables a good adjustment of the path of revolution to the desired working conditions of the device.

Further features of the invention will become obvious from the following description and drawings of an example of an embodiment of the invention.

Figure 1:
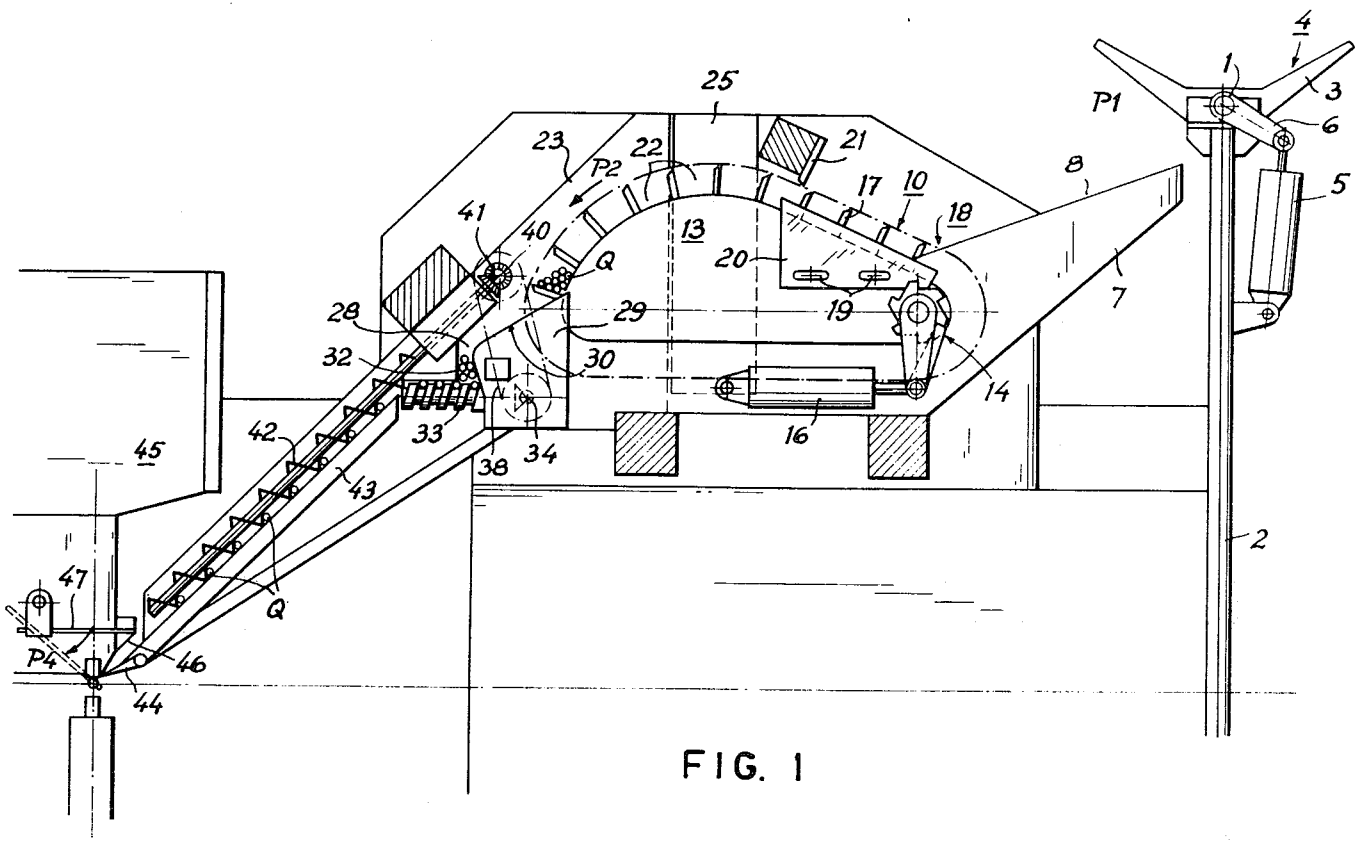
FIG. 1 is a schematic side elevation of the device according to the invention for feeding transverse lengths of wire to a lattice welding machine.
Figure 2:
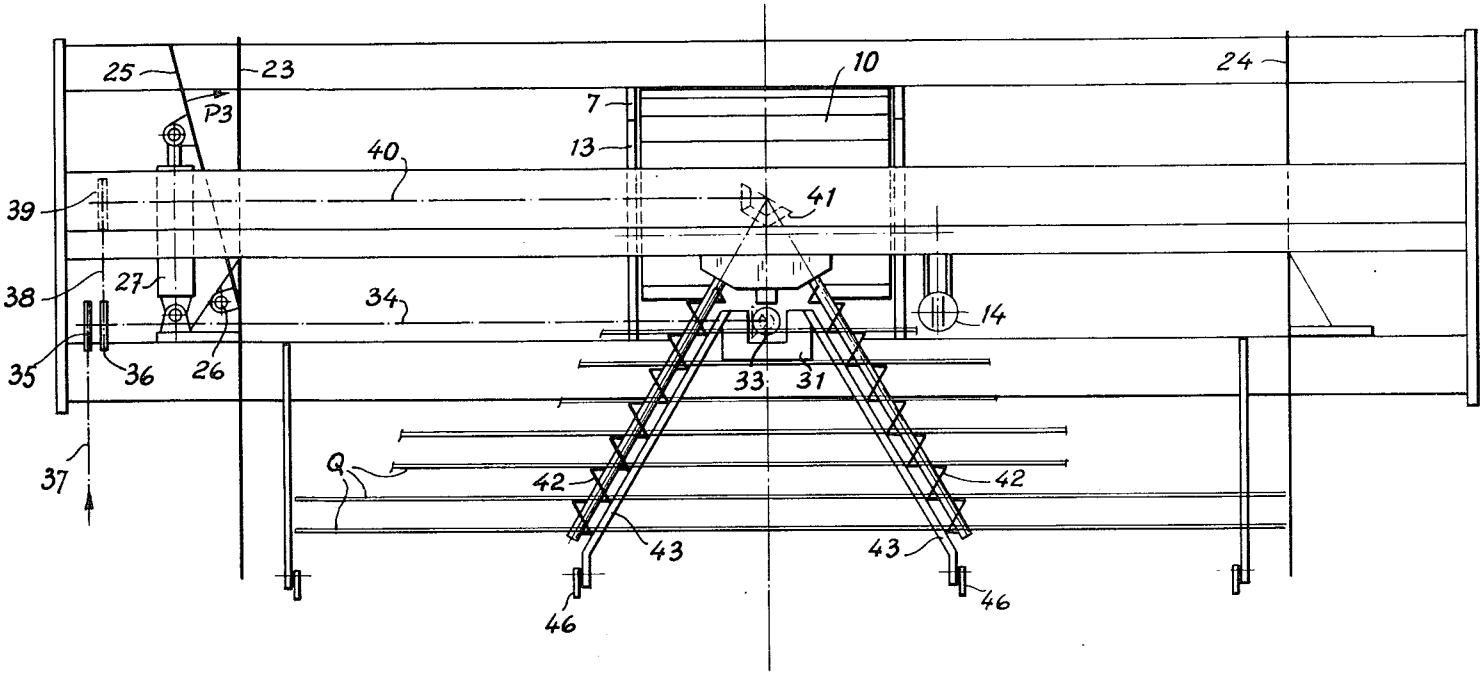
FIG. 2 is a schematic plan view of the device according to FIG. 1.

In the device according to FIGS. 1 and 2 a support, extending the whole width of a welding machine and swivelably fixed to a stand 2 by a bearing bolt 1, is provided with V-shaped supporting surfaces 3 arranged at intervals parallel to each other. These V-shaped supporting surfaces 3 form a basket-like container 4 for receiving a large quantity of evenly aligned transverse lengths of wire. The transverse wire lengths are placed into the container 4 as a loose bundle.

By means of a pneumatic or hydraulic cylinder 5 and a lever 6 non-rotatably connected with one of the bearing bolts 1 it is possible to tip the container 4 from its rest position in the direction of the arrow P1. The transverse lengths of wire stored in the container 4 are thus deposited onto two parallel supporting members or inclined-holding conveyor means 7 arranged at a distance from each other and laterally displaced relative the supporting surfaces 3. The upper edges 8 of the members 7 are inclined and form sliding surfaces. The container 4, after each return movement into its rest position, can immediately be re-supplied with fresh transverse lengths of wire.

Figure 3:
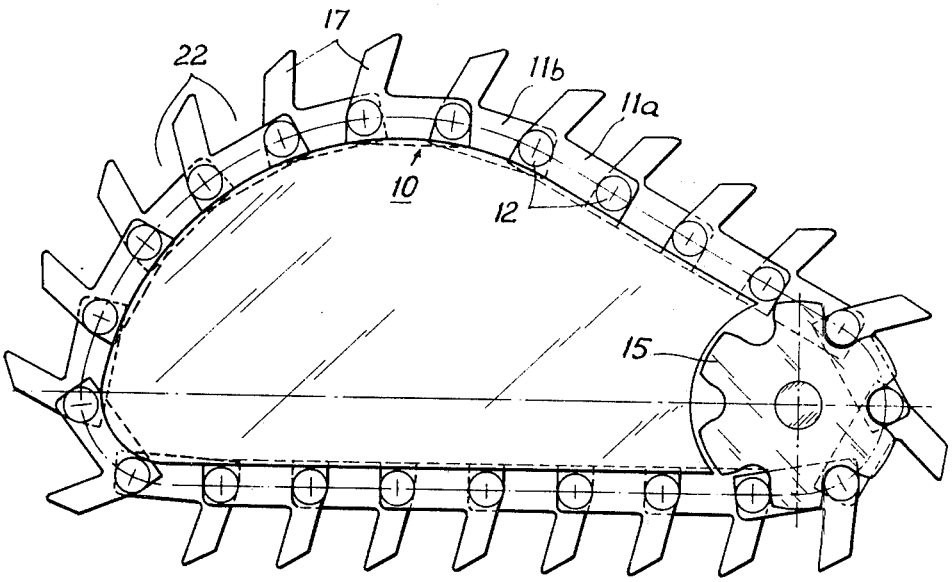
FIG. 3 shows a view of the paddle chain of this invention on an enlarged scale.

Between the two supporting members 7 there is arranged in a housing a continuous paddle chain 10, separately shown on its own in FIG. 3, from which paddles 17 extend upwards normally essentially over the whole circumference of the chain. The entire chain is composed of two types of links, e.g., outer links 11*a* and inner links 11*b*. The two types of links are shaped so that they can be meshed in a cog-like manner at the interconnecting swivel points. Each of the two essentially L-shaped chain links has two drillings, one in the link at which the two arms of the L meet, and the other in the end of the longer arm. These drillings contain guide bolts which carry guide rollers 12 on the outside. On the side walls 13 of the chain housing there are provided guide grooves for the rollers 12. The chain 10 is driven for example by a pneumatic or hydraulic cylinder 16 and a pawl drive 14 which rotates a chain wheel 15.

The upwardly extending arms of the chain links 11*a*, 11*b* form the paddles 17 which extend at right angles over the central area of the supply path of the transverse wire lengths. In conjunction with the sloping upper edges 8 of the supporting members 7 the paddle chain 10 forms an essentially V-shaped trough 18 into which the transverse wire lengths are tipped out of the container 4. As a result of the slope of the upper edges 8 of the supporting members 7 towards the paddle chain 10 the transverse wire lengths supported by the members 7 slide or roll towards the deepest point of the trough 18, i.e., towards the paddles 17. Then, when the paddle chain 10 is rotated in the direction of the arrow P2 a number of transverse wires are deposited in box-like compartments 22, formed between adjacent paddles 17, and conveyed along by the continuously moving paddle chain. The carrying capacity of the compartments 22 is substantially smaller than that of the trough 18.

On both sides of the paddle chain 10 there are screw-lockable limiter plates 20 displaceably arranged in oblong holes 19 for limiting the depth of the box-like wire retaining compartments 22 formed by the paddles 17 near the area in which the transverse wires are transferred from the supporting members 7 to the paddle chain 10. This has the effect that fewer transverse wire lengths are received than could be accommodated between two adjacent paddles 17 because of the size of each box-like compartment 22. Near the upper end of the limiter plates 20 there is provided a stripper 21 for stripping off any transverse wire lengths which protrude beyond the upper limit of the paddles 17.

When a compartment 22, formed of two adjacent paddles 17, is advanced to the far end of the rear edge of the limiter plates 20 the transverse wire lengths 2 drop down until they come to rest on the two side walls 13 of the chain housing. They are now positioned deep inside the compartment 22 formed by the two adjacent paddles 17 and can thus be safely further conveyed.

During transport the transverse wire lengths are laterally guided by two limiting panels 23, 24, which can be seen in FIG. 2. A flap 25 swivelling about an axis 26 is provided on the side of the limiting panel 23 and in front of the same in the advancing direction of the transverse wires. A pneumatic or hydraulic work cylinder 27 can move the flap 25 from a position indicated by arrow P3 (FIG. 2) into the plane of the limiting panel 23 and back again into its rest position. This movement aligns all the transverse wire ends in precisely the same plane. The drive of the flap 25 is synchronized with the pawl drive 14 of the paddle chain 10 in such a way that simultaneously with each forward step of the paddle chain the flap 25 is pivoted into the plane of the limiting panel 23 and back again.

In the area of the path of the paddle chain 10 opposite the V-shaped trough there are provided guide walls 29 on the forwardly sloping upper edges 30 of which the transverse wire lengths, resting in a compartment 22 between two adjacent paddles 17 of the chain 10, are placed. Under the effect of gravity the transverse wire lengths then roll or slide along the sloping upper edges 30 of the guide walls 29 until they reach an intermediate storage chamber 28, which is flanked by the forward edges of the guide wall 29, the two arms of a small U-shaped platform 31 (FIG. 2) and the vertical edge of a second stripper member 32, and which has a capacity which corresponds approximately to that of the compartment 22.

Figure 4:
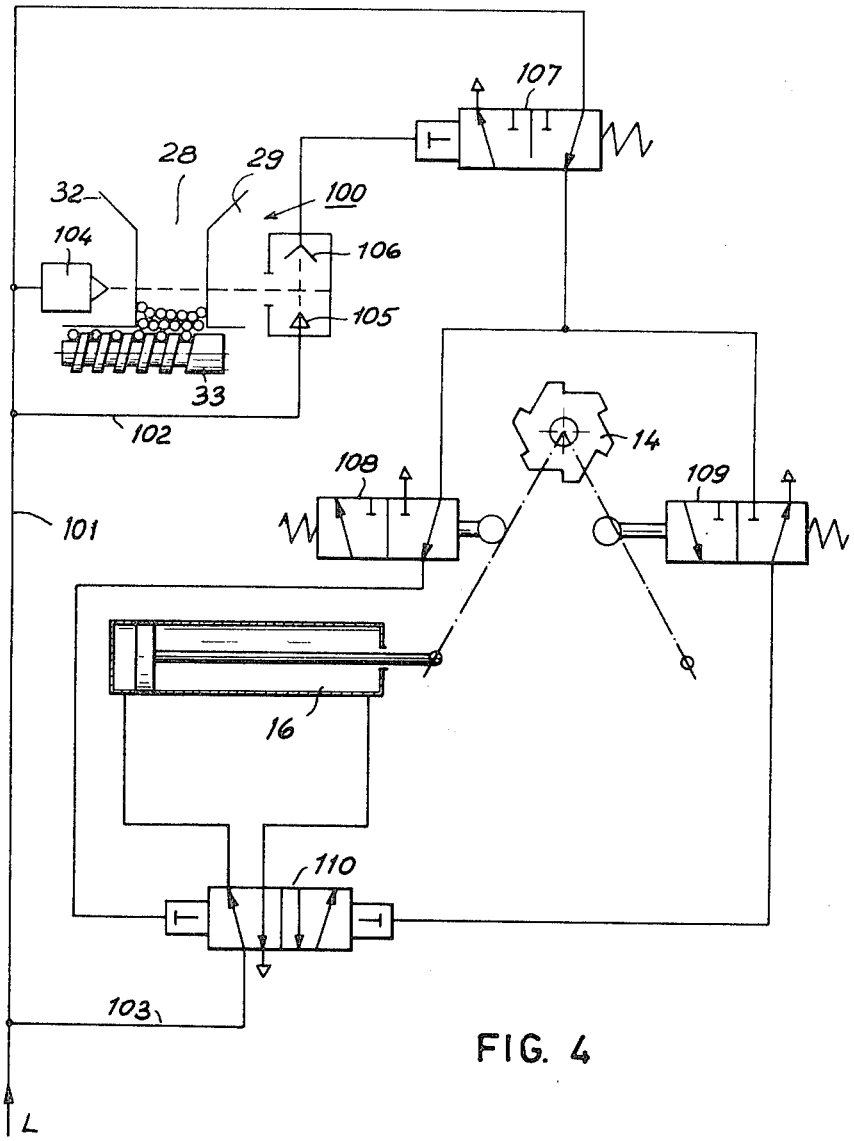
FIG. 4 represents a sensing and control device for the step-by-step forward movement of the paddle chain.

According to FIG. 4 compressed air from a source L is fed into feed pipes 101, 102, 103. The feed pipe 101 supplies the nozzle 104 from which the air can escape. The air jet from the nozzle 104 passes across the storage chamber 28, insofar as wires arranged in this chamber do not deflect it. The air jet thus determines a level and simultaneously senses the wires located at this level.

The nozzle 105 supplied by the feed pipe 102 simultaneously discharges a jet of air which in the unimpeded condition is directed into a funnel shaped collector 106. The sensor formed of the nozzle 105 and the collector 106 is connected via an air pipe with a spring loaded sensor valve 107. shaped In FIG. 4 it is assumed that there are so few wires in the storage chamber 28 that the air jet from the nozzle 104 is able to cross the storage chamber 28 unimpeded. The air jet from the nozzle 104 strikes the air jet from the nozzle 105 sideways and causes this to deflect in such a way that it does not hit the collector 106.

The sensor valve 107 is therefore not actuated by the collector 106 and is thus retained by its spring in the position indicated in which it connects the feed pipe 101 and branch pipes with two pneumatic terminal switches 108 and 109 which sense the position of the pawl drive 14 or the piston of the pneumatic cylinder 16, respectively.

In the position indicated the piston of the cylinder 16 is in its forward dead centre position and the terminal switch 108 acts against the action of its spring in such a way that the control valve 110 is actuated from the left and releases the compressed air to flow from the feed pipe 103 to the front face of the piston 16. The piston thus performs a work stroke.

As soon as the piston starts to move from the indicated position to the right, the terminal switch 108 under the effect of its spring cuts off the air supply to 110. The control valve 110 however remains in the position indicated, since no external forces act upon it now, until the pawl drive actuates the terminal switch 109, whereby a control pulse is transmitted to the right-hand side of the control valve 110 which reverses this in such a way that the piston in the cylinder 16 is actuated from right to left.

When the number of wires in the storage chamber 26 are such that the air jet from the nozzle 104 is deflected, then the air jet from the nozzle 105 hits the collector 106. This has the effect of operating the sensor valve 107 against the action of its spring, interrupting the feed pipe 101 through the sensor valve 107 and simultaneously releasing the air from this sensor valve to the terminal switches 108, 109. The control valve 110 remains in the position it has attained at that moment. Since the operation of the terminal switch for limiting the momentary movement of the piston is now unable to effect a reversal of the control valve 110, because the branch pipes to the terminal switches have now been emptied, the piston in the cylinder 16 completes its travel and remains in its momentary dead center position until a new control sequence initiated by the control valve 107 starts a new operating cycle.

In this way the intermediate storage chamber is intermittently supplied with measured quantities of transverse lengths of wire.

For separating the transverse lengths of wire there is arranged between the two arms of the small platform 31 a threaded spindle 33, which is driven by a shaft 34 and a pair of bevel gears (only roughly indicated). The shaft 34 carries two chain wheels 35 and 36 at the end facing away from the spindle 33. The chain wheel 35 is driven by a chain 37 which in its turn is driven by a continuously operating motor (not shown). A chain 38 connects the chain wheel 36 with chain wheel 39 which drives a shaft 40. Through a bevel gear 41 the shaft 40 finally drives two straddled V-shaped threaded spindles 42, which are arranged symmetrically to the spindle 33, which serve to further convey the transverse lengths of wire. The threaded spindles 33 and 42 are thus continuously kept in rotating motion.

The grooves between the threads of the spindle 33 are of such depth and width that only one single transverse length of wire Q can rest in it at any one time and to be passed through beneath the stripper 32. Of all the transverse wire lengths located in the already mentioned intermediate storage chamber 28, with its limited capacity, only one is picked up by the spindle 33 about roughly in the centre, freely drawn away from the remaining smaller number of the transverse wire lengths located in the intermediate storage chamber 28, and advanced towards the conveying spindles 42. Each one of the wire lengths reaching the spindles 42 is now conveyed between the threads of these spindles and, with the aid of guide rails 43 cooperating with these spindles, conveyed along these guide rails to the electrodes of a known type of welding machine 45, whereby the supporting points of the transverse wire lengths divide at the point where the spindles 42 and the guide rails 43 start to straddle, thereby firmly holding the transverse wire lengths.

When a transverse wire length has reached the lower end of the spindle 42 it continues to slide under the effect of gravity until it comes to rest between a stop 46 on the actual welding machine and a spring-loaded flap 44 at the lower end of the guide rail 43. When it pivots from its rest position into the position indicated by the broken lines in the direction of the arrow P4 the transverse wire length feeder 47 of the welding machine presses against the transverse wire length, thereby opening the spring loaded flap 44 and conveying the transverse wire length between the electrodes of the welding machine.

For simplifying the drawing, the transverse wires Q in FIGS. 1 and 2 are shown only in one compartment 22 of the paddle chain 10, in the intermediate storage chamber 28 and in the threads of the spindles 33 and 42.

This example of an embodiment according to the invention is of course not restricted to it and various modifications can be employed. For example, in place of the continuous paddle chain a rotating paddle wheel may be used. In place of the threaded spindle for separating the wire lengths it is also possible to use rotating discs with peripheral grooves which cooperate with a stripper. Also with respect to the control of the device, which in the example of the embodiment is pneumatically or hydraulically operated, there are of course also numerous other possible variations.

We therefore wish it to be understood that we do not desire to be limited to the exact details of construction shown and described, for obvious modifications will occur to a person skilled in the art.

Having thus described the invention, what we claim as new and desire to be secured by Letters Patent, is as follows:

1. An apparatus for feeding aligned lengths of wire from a bundle to a processing machine, such as a lattice welding machine, comprising, in combination:

an inlet means operable to convey and hold the bundle for division into smaller portions;

conveyor means disposed near said inlet means, operable to convey portions of wire away from said inlet means;

divider means associated with at least one of said conveying or inlet means and operable to divide said bundle into portions of wire;

holder-separator means disposed near said conveyor means and being operable to receive the portion of wire from said conveyor means and separate it into individual wires in a predetermined alignment, for conveyance to the processing machine.

2. An apparatus, as claimed in claim 1, wherein said conveyor means further includes aligning-quantity control means operable to control the size of the portion of wire and acting to insure that the individual wires in the portion of wire being conveyed, are aligned to within predetermined tolerances; and said holder-separator means being operable to substantially align the portion of wire received into it.

3. An apparatus, as claimed in claim 2, wherein said aligning-quantity control means includes a stripper member, disposed above said paddle devices and operable to limit the height of wires held in said compartments above said belt and thereby limit the quantity of wires in each compartment.

4. An apparatus, as claimed in claim 1, wherein said inlet means includes a first inclined holding-conveyor means being downwardly inclined from a receiving end and operable to receive a bundle of loose lengths of wire at said receiving end;

said conveyor means including a movable endless belt being disposed adjacent said first holding-conveyor means and having a moving means operable to move it, said belt including spaced apart paddle devices extending away from said belt to form wire retaining compartments on said belt, each retaining compartment having a smaller capacity than said holding-conveyor means, said holding-conveyor means being operable to convey said loose wire lengths into said retaining compartments whereby a portion of the bundled wire will be conveyed from said holding-conveyor means by the movement of said movable belt;

a storage chamber;

said holder-separator means comprising a second downwardly inclined holding-conveyor means operable to receive the wires from said belt and convey them into said storage chamber and a separating member disposed adjacent the wires contained in said storage chamber, operable for separating them into individual wires and conveying the individual wires to the processing machine.

5. An apparatus, as claimed in claim 4, wherein said endless belt travels in an upward direction over at least part of the conveyance path of the portion of wire from said holding means to said storage chamber, wherein said aligning-quantity control means includes a depth limiting means disposed adjacent said belt and operable to limit the depth to which said portion of wire can be held in each compartment during filling.

6. An apparatus, as claimed in claim 4, wherein said holder-separator means includes a rigid abutment surface disposed along one edge of said endless belt; and a pivotable abutment surface disposed opposite said rigid abutment surface along the other edge.

7. An apparatus, as claimed in claim 6, including a device for pivoting said pivotable abutment surface in a direction toward and away from said rigid abutment surface, in synchronism with the movement of said belt.

8. An apparatus, as claimed in claim 4, said second holding-conveyor means comprising guide panels disposed near each edge of said belt and having downwardly sloping upper edges forming an inclined path into said storage chamber.

9. An apparatus, as claimed in claim 4, wherein said belt comprises interlinked L-shaped chain links, whereby part of the L-shape forms said paddle.

10. An apparatus, as claimed in claim 4, said separating member comprising a first threaded spindle disposed near the bottom of said intermediate chamber.

11. An apparatus, as claimed in claim 10, said separating member further comprising two threaded spindles operable to receive a single wire from said first threaded spindle and convey it substantially parallel to the processing machine; and guide walls disposed along said threaded spindles and having upper edges substantially parallel to said threaded spindles, to guide the single wires conveyed by said threaded spindles.

12. An apparatus, as claimed in claim 1, further comprising moving means for activating said conveying means, and sensing means for said holder-separator means operable for sensing the quantity of wires and for actuating said moving means to advance said conveying means when the quantity of wires falls below a predetermined level in said holder-separator means.

13. An apparatus, as claimed in claim 12, said moving means operating in a stepwise manner when activated thereby advancing said conveying means for a predetermined distance.

14. An apparatus, as claimed in claim 12, wherein said sensing means comprises first means operable to direct a first stream of gas through said holder-separator means at a predetermined height, a gas stream receiver including a switch, and second means operable to direct a second stream of gas towards said switch in said receiver, said switch being actuatable when said second stream impinges thereagainst to actuate said moving means, said first gas stream flowing in the direction towards said second gas stream in said receiver when the wires are below said predetermined level, to deflect said second gas stream away from said switch.

* * * * *